US005422977A

United States Patent [19]

Patterson et al.

[11] Patent Number: 5,422,977

[45] Date of Patent: Jun. 6, 1995

[54] APPARATUS AND METHODS FOR THE GENERATION OF STABILISED IMAGES FROM WAVEFORMS

[75] Inventors: Roy D. Patterson; John W. Holdsworth, both of Cambridge, United Kingdom

[73] Assignee: Medical Research Council, London, England

[21] Appl. No.: 776,301

[22] PCT Filed: May 17, 1990

[86] PCT No.: PCT/GB90/00767

§ 371 Date: Jan. 25, 1993

§ 102(e) Date: Jan. 25, 1993

[87] PCT Pub. No.: WO90/14656

PCT Pub. Date: Nov. 29, 1990 (Under 37 CFR 1.47)

[30] Foreign Application Priority Data

May 18, 1989 [GB] United Kingdom ..... 8911374

[51] Int. Cl.[6] ..... G10L 9/00

[52] U.S. Cl. ..... 395/2.85

[58] Field of Search ..... 395/2.85, 2.35, 2.36, 395/2.37; 381/41–43; 382/29, 40, 54, 57; 364/413.17, 413.19, 413.22

[56] References Cited

U.S. PATENT DOCUMENTS 2,181,265 11/1939 Dudley ..... 179/100.1
3,087,487 4/1963 Clynes ..... 128/2.1
4,802,225 1/1989 Patterson ..... 381/49
4,969,194 11/1990 Ezawa et al. ..... 381/51

FOREIGN PATENT DOCUMENTS 1179029 6/1967 United Kingdom .

OTHER PUBLICATIONS

D. E. Wood: "New Display Format and a Flexible–Time Integrator for Spectral–Analysis Instrumentation"; The Journal of the Acoustical Society of America, vol. 36, No. 4, Apr. 1964; pp. 639–643.

W. Auth et al.: "Dreidimensionale Darstellung von sprachgrundfrequenzsynchron berechneten Sprach–SpektrogrammenNachrichtentechnische Zeitschrift N.T.Z., vol. 24, No. 10 Oct. 1971, (Berlin, DE); pp. 502–507.

*Primary Examiner*—Allen R. MacDonald
*Assistant Examiner*—Michelle Doerrler
*Attorney, Agent, or Firm*—St. Onge Steward Johnston & Reens

[57] ABSTRACT

Peaks are detected in the waveform and in response to the detection of peaks, successive segments of the waveform are sampled. The successive segments sampled are then summed with previously summed segments to produce a stabilized image of the waveform. The generation of the stabilized image is a data-driven process and one which is sensitive and responsive to periodic characteristics of the waveform and hence is particularly useful in the analysis of sound waves and in speech recognition systems.

20 Claims, 6 Drawing Sheets

8
SPEECH WAVE FROM AIR
9
BANK OF BANDPASS FILTERS
10
BANK OF ADAPTIVE THRESHOLD DEVICES
14
TIMBRE EXTRACTOR
11
BANK OF STABILISED IMAGE GENERATORS
13
PITCH EXTRACTOR
12
BANK OF SPIRAL PERIODICITY DETECTORS
15
AUDITORY FEATURE EXTRACTOR
16
SYNTACTIC PROCESSOR
17
SEMANTIC PROCESSOR
18
LINGUISTIC PROCESSOR
19
ORDERED RECORD OF WORDS

APPARATUS AND METHODS FOR THE GENERATION OF STABILISED IMAGES FROM WAVEFORMS

The invention relates to apparatus and methods for the generation of stabilised images from waveforms. It is particularly applicable to the analysis of non-sinusoidal waveforms which are periodic or quasi-periodic.

Analysis of non-sinusoidal waveforms is particularly applicable to sound waves and to speech recognition systems. Some speech processors begin the analysis of a speech wave by dividing the speech wave into separate frequency channels, either using Fourier Transform methods or a filter bank that mimics that encountered in the human auditory system to a greater or lesser degree. This is done in an attempt to make the speech recognition system noise resistant.

In the Fourier Transform method small segments of the wave are transformed successively from the time domain to the frequency domain, and the components in the resulting spectrum are analysed. This approach is relatively economical, but it has the disadvantage that it destroys the fine grain temporal information in the speech wave before it has been completely analysed.

In the filter bank method the speech wave is divided into channels by filters operating in the time domain, and the result is a set of waveforms each of which carries some portion of the original speech information. The temporal information in each channel is analysed separately and is usually divided into segments and an energy value for each segment determined so that the output of the filter bank is converted into a temporal sequence of energy values. The segment duration is typically in the range 10–40 ms. The integration is insensitive to periodicity in the information in the channel and again fine grain temporal information in the speech wave is destroyed before it has been completely analysed. At the same time with regard to detecting signals in noise, the segment durations referred to above are too short for sufficient integration to take place.

Preferably the temporal integration of a non-sinusoidal waveform is a data-driven process and one which is sensitive and responsive to periodic characteristics of the waveform.

Although the invention may be applied to a variety of waves or mechanical vibrations, the present invention is particularly suited to the analysis of sound waves. The invention is applicable to the analysis of sound waves representing musical notes or speech. In the case of speech the invention is particularly useful for a speech recognition system in which it may be used to assist pitch synchronous temporal integration and to distinguish between periodic signals representing voiced parts of speech and aperiodic signals which may be caused by noise.

The invention may be used to assist pitch synchronous temporal integration generating a stabilised image or representation of a waveform without substantial loss of temporal resolution. The stabilised image of a waveform referred to herein is a representation of the waveform which retains all the important temporal characteristics of the waveform and is achieved through triggered temporal integration of the waveform as described herein.

The present invention seeks to provide apparatus and methods for the generation of a stabilised image from a waveform using a data-driven process and one which is sensitive and responsive to periodic characteristics of the waveform.

The present invention provides a method of generating a stabilised image from a waveform, which method comprises detecting peaks in said waveform, in response to detecting peaks sampling successive time extended segments of said waveform, and forming a summation output by combining first signals representing each successive segment with second signals derived from said summation output formed by previous segments of said waveform, said summation output tending towards a constant when said waveform is constant, whereby said summation output forms a stabilised image of said waveform.

The present invention further provides a method wherein the first and second signals are combined by summing the signals together, the second signals being a reduced summation output and wherein the summation output is reduced by time dependant attentuation to form the reduced summation output. In addition preferably a first limit of the time extended segments of said waveform is determined by the detection of peaks in said waveform and either a second limit of the time extended segments of said waveform is a predetermined length of time after the first limit of the time extended segments of said waveform or a second limit of the time extended segments of said waveform is determined by the detection of peaks in said waveform.

In addition the present invention provides for the analysis of a non-sinusoidal sound wave a method which further includes the spectral resolution of a waveform into a plurality of filtered waveforms each filtered waveform independantly having a stabilised image generated. Preferably said method further comprises the extraction of periodic characteristics of the sound wave and the extraction of timbre characteristics of the sound wave.

A second aspect of the present invention provides apparatus for generating a stabilised image from a waveform comprising (a) a peak detector for receiving and detecting peaks in said waveform, (b) means for sampling successive time extended segments of said waveform, said sampling means being coupled to said peak detector, (c) combining means for combining first signals representing each successive segment with second signals to form a summation output, said second signals being derived from said summation output, said combining means being coupled to said sampling means, and (d) feedback means being coupled to said combining means, said summation output tending towards a constant when said waveform is constant, whereby said summation output forms a stabilised image of said waveform.

Furthermore the present invention provides speech recognition apparatus including apparatus as described above together with means for providing auditory feature extraction from analysis of the filtered waveforms together with syntactic and semantic processor means providing syntactic and semantic limitations for use in speech recognition of the sound wave.

Embodiments of the invention will now be described by way of example only and with reference to the accompanying drawings, in which.

Although these embodiments are applicable to the analysis of any oscillations which can be represented by a waveform, the description below relates more specifically to sound waves. They provide apparatus and methods for the generation of a stabilised image from a waveform by triggered temporal integration and, may be used to assist in distinguishing between periodic and aperiodic waves. Periodic sound waves include those forming the vowel sounds of speech, notes of music and the purring of motors for example. Background noises like those produced by wind and rain for example are aperiodic sounds.

Temporal integration of a waveform is necessary when analysing the waveform in order to identify more clearly dominant characteristics of the waveform and also because without some form of integration the output data rate would be too high to support a real-time analysis of the waveform. This is of particular importance in the analysis of sound waves and speech recognition.

When analysing a non-sinusoidal sound wave, commonly the wave is firstly divided into separate frequency channels by using a bank of bandpass frequency filters. When analysing the sound wave by studying the resultant outputs from channels of the bank of frequency filters it is necessary that the information be processed. A number of processes are applied to the output of the channels in the form of compression, rectification and adaption on a channel by channel basis to sharpen distinctive features in the output and reduce 'noise' effects. Thus, referring to FIG. 2 a subset of seven driving waves from the channels of a filterbank is shown and in FIG. 3 the same sub-set of driving waves with the driving waves having been rectified and compressed is shown. The seven channel outputs shown in FIGS. 2 and 3 were obtained from spectral analysis of a sound wave which starts at a first pitch and glides quickly up to a second higher pitch.

Figure 1:
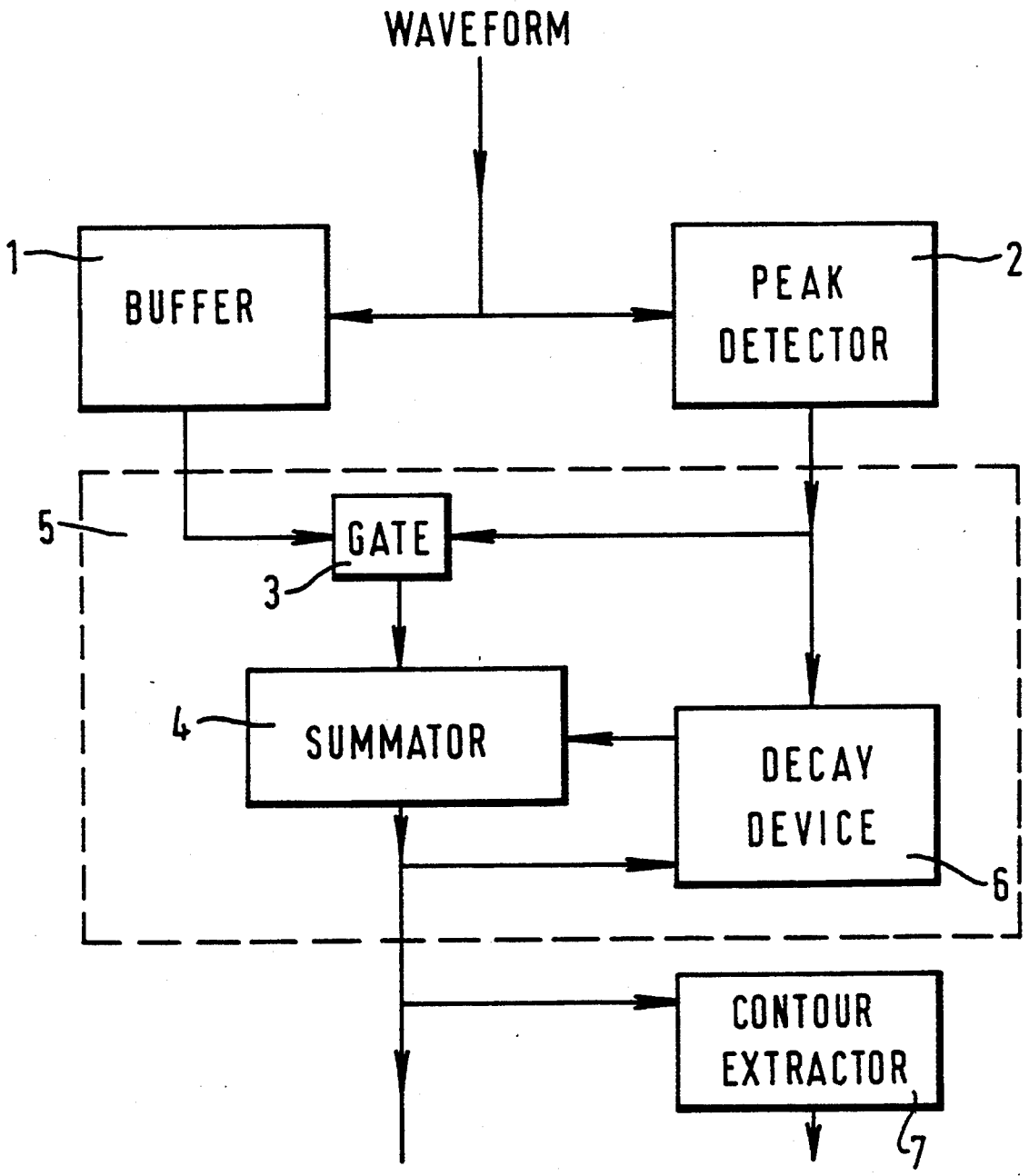
FIG. 1 is a block diagram of apparatus for generation of a stabilised image from a waveform according to the invention.

For analysis of the sound wave it is also necessary for the output of each channel to be temporally integrated. However, such integration must occur without substantial loss of temporal resolution. Referring now to FIG. 1, a schematic diagram of a stabilised image generator is shown which may be used to temporally integrate the output of a channel of a filterbank. The integration carried out by the stabilised image generator is triggered and quantised so that loss of temporal resolution from the integration is avoided. A stabilised image generator may be provided for each channel of the filterbank.

The stabilised image generator has a peak detector (2) coupled to sampling means in the form of a buffer (1) and a gate (3) or other means for controlling the coupling between the buffer (1) and a summator (4) or other combining means. The gate (3) and summator (4) form part of an integration device (5). The summator (4) is also coupled to a decay device (6) and forms a feedback loop with the decay device (6) in the integration device (5). Thus the output of the summator (4) is coupled to the input of the decay device (6) and the output of the decay device (6) is coupled to an input of the summator (4). The decay device derives the second input into the summator (4) from the output of the summator (4). The decay device (6) is also coupled to the peak detector (2). The summator (4) has two inputs, a first input which is coupled to the gate (3) and a second input which is coupled to the output of the decay device (6). The two inputs receive an input each from the gate (3) and the decay device (6) respectively. The two inputs received are then summed by the summator (4) and the summation output of the summator (4) is the resultant summed inputs and is a stabilised image of the input into the buffer (1). The summation output of the summator (4) is also coupled to a contour extractor (7) which temporally integrates over the stabilised image from the summator (4) and which has a separate output.

Figure 4:
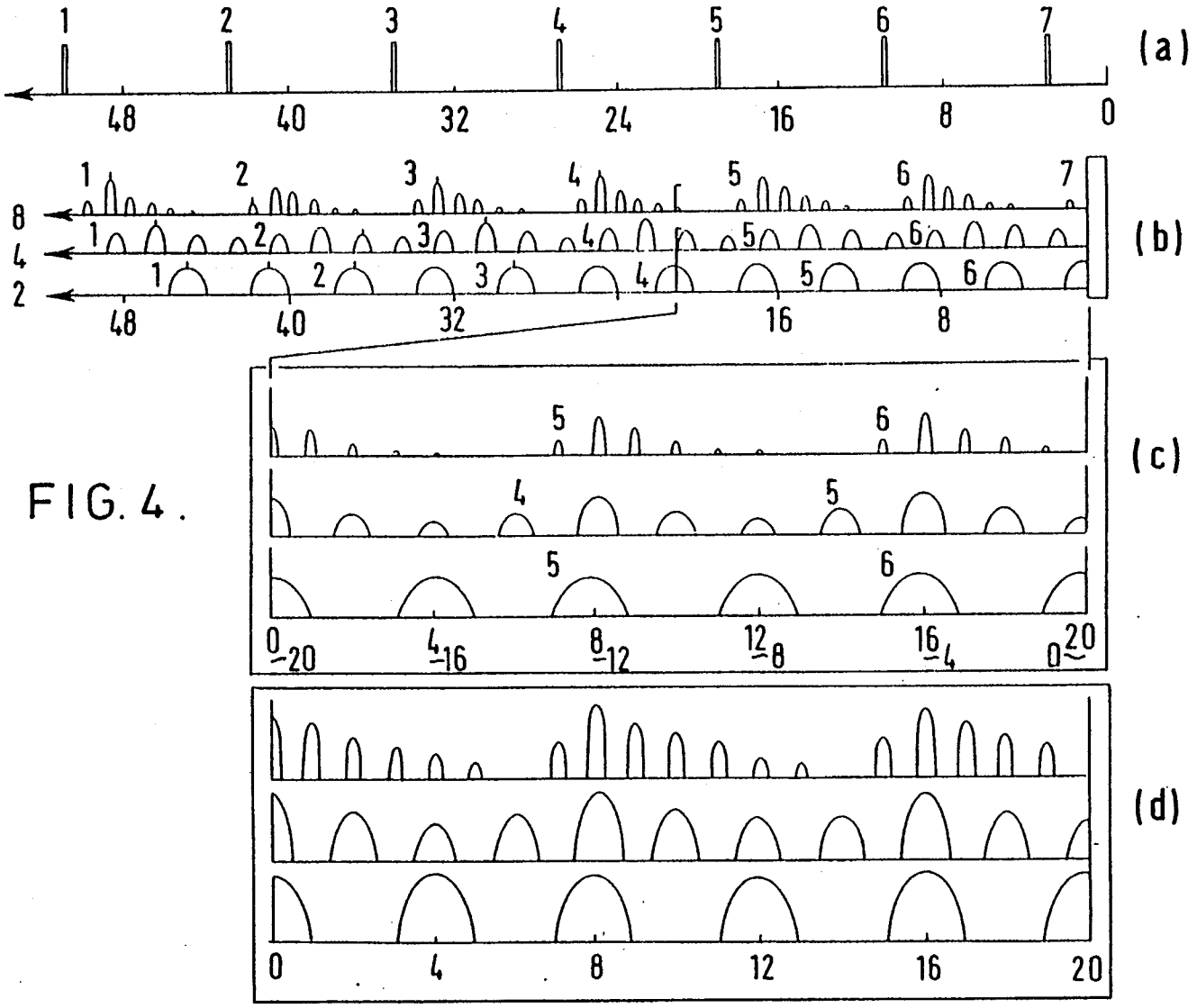
FIG. 4 is a schematic diagram of the temporal integration of three harmonics of a sound wave according to a first embodiment of the invention.

Referring to FIGS. 4*a–d* and 5*a–d*, the period of a sound wave is represented schematically as a pulse stream in FIGS. 4*a* and 5*a* having a period of 8 ms and with just over 6 cycles shown. FIGS. 4*b* and 5*b* show schematically the output of three channels of a filterbank in response to the sound wave, the three channels having centre frequencies in the region of the second, fourth and eighth harmonics of the sound wave. The first pulse in each cycle is labelled with the cycle number and the harmonics are identified on the left hand edge of FIGS. 4*b* and 5*b*. The time axes are the same in FIGS. 4*a*, 4*b*, 5*a* and 5*b*.

Referring now to the representation of the eighth harmonic in FIGS. 4*a–d*, the output of the channel in the form of a pulse stream or waveform is input into the stabilised image generator through the buffer (1) and separately into the peak detector (2). In this example the buffer (1) has a fixed size of 20 ms and there is a time delay mechanism whereby the peak detector (2) receives the pulse stream approximately 20 ms after the pulse stream was initially received by the buffer (1). The buffer (1) is transparent and retains the most recent 20 ms of the pulse stream received. The peak detector (2) detects major peaks in the pulse stream and on detection of a major peak issues a trigger to the gate (3). When the gate (3) receives a trigger from the peak detector (2) the gate (3) opens to allow the contents of the buffer (1) at that instant to be read by the first input of the summator (4). Once the contents of the buffer (1) has been read by the summator (4) the gate (3) closes and the process continues until a further trigger is issued from the peak detector (2) when the gate (3) opens again and so on.

In the summator (4) the contents of the buffer (1) read by the first input of the summator (4) is added to the input pulse stream of the second input of the summator (4). The output of the summator (4) is the resultant summed pulse stream. Initially, there is no pulse stream input to the second input of the summator (4) and the output of the summator (4) which is the summed pulse stream is the same as the pulse stream received from the buffer (1) by the first input of the summator (4). However, the second input of the summator (4) is coupled to the output of the decay device (6) and in turn the input of the decay device (6) is coupled to the output of the summator (4); thus after the initial output from the summator (4) the second input of the summator (4) has an input pulse stream which is the same as the output of the summator (4) except that the pulse stream has been attenuated.

The decay device (6) has a predetermined attenuation such that it is sufficiently slow that the stabilised image will produce a smooth change when there is a smooth transition in the pulse stream input into the buffer (1). If however, the periodicity of the pulse stream input into the buffer (1) remains the same the stabilised image is strengthened over an initial time period for example 30 ms and then asymptotes to a stable form over a similar time period such that the pulse stream input into the first input of the summator (4) is equal to the amount the summed pulse stream is attenuated by the decay device (6). The resultant stabilised image has a greater degree of contrast relative to the pulse stream input into the buffer. If the pulse stream into the first input of the summator (4) is set to zero then the summator (4) continues to sum the two inputs, and the stabilised image gradually decays down to zero also. The predetermined attenuation is proportional to the logarithm of the time since the last trigger was issued by the peak detector (2) and the issuance of a trigger by the peak detector (2) may be noted by the decay device (6) through its coupling with the peak detector (2) though this is not necessary.

The 't' marker on FIG. 4*b* at about 20 ms indicates the detection point of the peak detector (2) relative to the pulse stream being received by the buffer (1). The contents of the buffer (1) being retained at that moment is the pulse stream appearing between the 't' marker and the far right of the diagram at 0 ms. The upward strokes on certain peaks of the pulse stream of the eighth harmonic indicate previous peaks detected for which triggers were issued by the peak detector (2). FIG. 4*c* shows schematically the contents of the buffer (1) when the most recent trigger was issued by the peak detector (2). As may be seen by referring back to FIG. 4*b* for the eighth harmonic the previous trigger occurred in the fourth cycles and is shown in FIG. 4*c*. The fifth and sixth cycle of the pulse stream were also contained in the buffer (1) when the trigger was issued and they are also shown.

A similar process has been applied to the fourth and second harmonics each having been input into a separate stabilised image generator and FIG. 4*c* shows the contents of three buffers for the three channels when the most recent triggers were issued by the corresponding peak detectors. It may be seen that although the original outputs of the channels have a phase lag between them which is a characteristic of the channel filterbank, the three pulse streams in FIG. 4*c* have been aligned. This is an automatic result of the way in which the stabilised image generators work because the contents of the buffers which are read by the summator (4) will always be read from a peak. This is because the reading of the contents of the buffer is instigated by the detection of a peak by the peak detector. In terms of sound analysis and in particular speech recognition it has been shown that the ear cannot distinguish between sound waves having the same harmonics but different phases between the harmonics and so such an alignment of the pulse streams is advantageous. The pulse streams of the eighth, fourth and second harmonics shown in FIG. 4*c* are the pulse streams which are input into the first inputs of the respective summators (4).

FIG. 4*d* shows the stabilised images or representations of each harmonic. This stabilised image is the output of the summator (4) for each channel. The stabilised image has been achieved by summing the most recent pulse stream read from the buffer (1) with the attenuated stabilised image formed from the previous pulse streams read from the buffer (1). It may be seen that for the eighth harmonic an extra small peak has appeared in the stabilised image. This is because the peak detector may not always detect the major peak in the pulse stream. As is shown in FIG. 4*b*, at the second cycle of the pulse stream, the peak detector triggered at a minor peak. However, it may be seen from FIG. 4*d* that even with this form of error the resultant stabilised image is a very accurate representation of the original pulse stream output from the channel and that such errors only introduce minor changes to the eventual stabilised image. Similarly other 'noise' effects and minor variations in the pulse stream of the channel would not substantially effect the stabilised image. Broadly speaking, the variability in the peak detector (2) causes minor broadening and flattening of the stabilised image relative to the original pulse stream.

The stabilised image output from the summator (4) may then be input into a contour extractor (7) although this is not necessary. The contour extractor (7) temporally integrates over each of the stabilised image outputs to form a frequency contour and the ordered sequences of these contours forms a spectrogram. The formation of a spectrogram has been a traditional way of analysing non-sinsoidal waveforms but by delaying the formation of the spectrogram until after the formation of the stabilised image alot of noise and unwanted variation in the information is removed. Thus the resultant spectrogram formed after the formation of the stabilised image is a much clearer representation than a spectrogram formed directly from the outputs of the channels of the filterbank.

The integration time of the contour extractor (7) may be pre-set between the region, for example, 20 ms to 40 ms. If a pre-set integration time is used then the window over which the integration takes place should not be rectangular but should decrease from left to right across the window because the stabilised image is more variable to the right hand edges as is described later. Preferably however pitch information is extracted from the stabilised image so that the integration time may be set at one or two cycles of the waveform and so integration is synchronised to the pitch period.

The buffer (1) when used to generate a stabilised image has a perfect memory which is transparent in that the information contained in the buffer (1) is only the most recent 20 ms of the pulse stream received. Furthermore, the transfer of information from the buffer (1) to the first input of the summator (4) is instantaneous and does not involve any form of degeneration of the information.

Alternatively it is not necessary for the peak detector (2) to be delayed relative to the buffer (1) and the peak detector (2) may instead detect peaks in the pulse stream from the filter channel at the same time as the pulse stream is input into the buffer (4). On detection of a peak, the subsequent pulse stream for the next 20 ms is read by the first input of the summator (4) from the buffer (1). Otherwise the stabilised image generator acts in the same way as in the previous example.

In a further alternative the buffer (1) is not used and instead on detection of a peak by the peak detector (2), the gate (3) is opened to allow the pulse stream from the filter channel to be input directly into the first input of the summator (4). In this further method if the peak detector (2) issues a trigger within 20 ms of the last trigger then further channels to the first input of the summator (4) are required. For example, if the peak detector (2) issues a trigger to the gate (3), the gate (3) opens so that the pulse stream from the channel filter is input into the first input of the summator (4) for the next 20 ms. If the peak detector (2) then issues a further trigger to the gate (3), 5 ms later, the gate (3) opens a further channel to the first input of the summator (4) so that the pulse stream may be input into the summator (4) for the next 20 ms. Information in the form of two pulse streams are therefore input, in parallel, into the first input of the summator (4). The pulse stream in each channel of the first input of the summator (4) will be summed by the summator (4) with the pulse stream in any other channels of the first input to the summator (4) along with the pulse stream input into the second input of the summator (4) from the decay device (6).

In both of the above mentioned examples individual peaks may contribute more than once to the stabilised image at different points determined by the temporal distance between the peak and the peaks on which successive triggering has occured. This will increase the averaging or smearing properties of the stabilised image generation mechanism and will increase the effective integration time.

Figure 5:
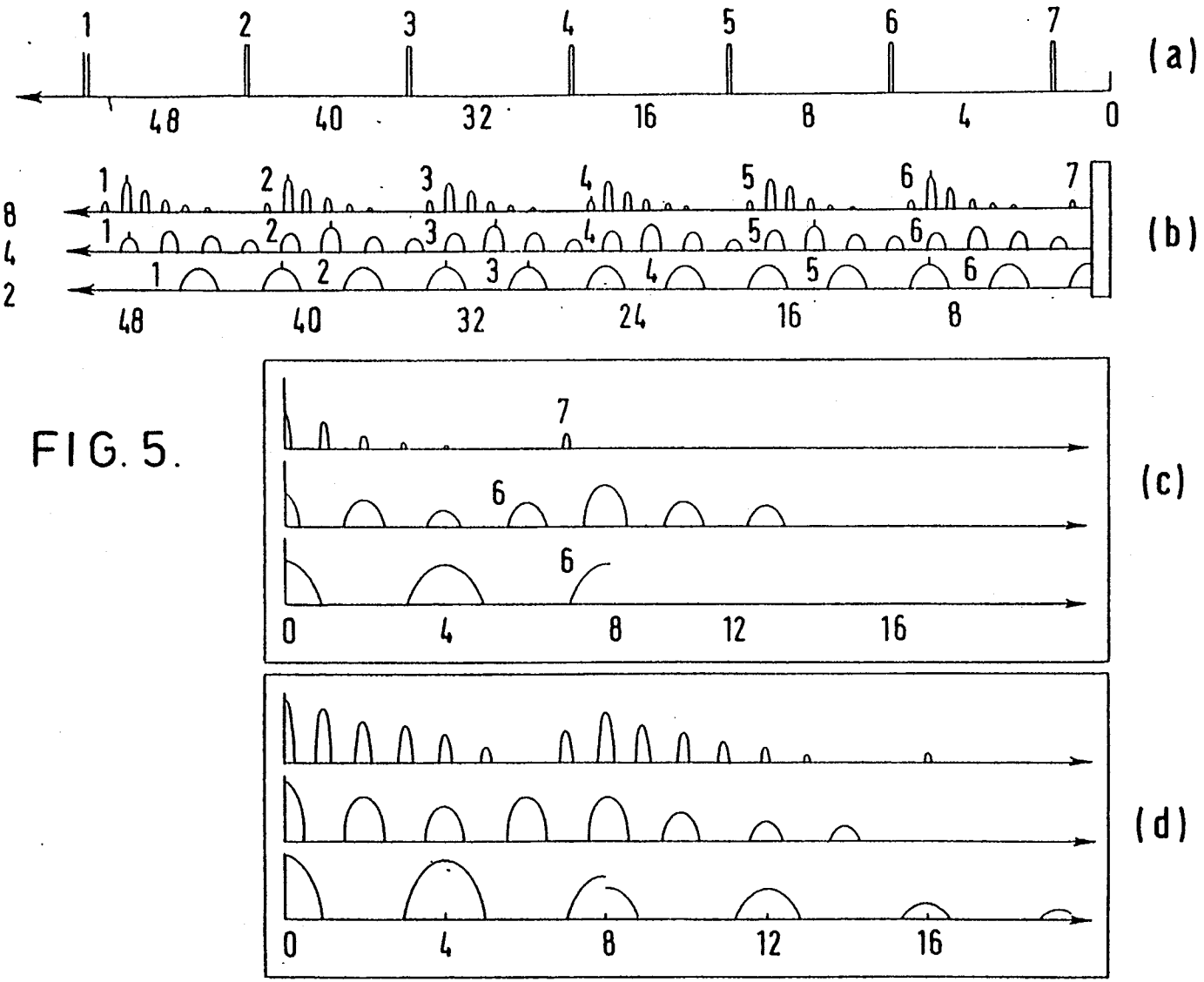
FIG. 5 is a schematic diagram, similar to FIG. 4, according to a further embodiment of the invention.

A further method of stabilised image generation is shown in FIG. 5. With this method the pulse stream from the output of the filter channel is input directly into the first input of the summator (4) on detection of a major peak by the peak detector (2) and issuance of a trigger from the peak detector (2). No use is made of the buffer (1) in this method and, unlike the previous examples, instead of the pulse stream from the output of the filter channel being supplied in segments of 20 ms the pulse stream is supplied to the summator (4) until a further trigger is issued by the peak detector (2) on detection of the next major peak in the pulse stream. Thus the summator (4) no longer sums 20 ms segments of the pulse stream from the filter channel. The segments of the pulse stream being summed are variable depending upon the length of time since the last trigger.

Thus, it may be seen in FIG. 5*c* that since the last trigger, only just over one cycle has been supplied to the summator (4) for the eigth harmonic, almost two cycles for the fourth harmonic and two cycles for the second harmonic. Hence the segment time length is reduced in this third method for the purpose of integration. Furthermore any one peak in the pulse stream is integrated only once instead of possibly two or three times as in the previous examples. FIG. 5*d* shows schematically the resultant stabilised image for each harmonic and again it may be seen that even taking into account variability in the issuance of the trigger by the peak detection (2) the stabilised images retain the overall features of the pulse streams from the filter channels. With reference to the second harmonic in FIG. 5*d* the discontinuity in the peak at 8 ms shows the formation of the stabilised image in progress. Hence from 0 to 8 ms in FIG. 5*d* for the second harmonic the most recent pulse stream has been summed with the attenuated pulse stream from the decay device (6) whereas from 8 ms onwards the previous stabilised image is shown.

The pulse streams to the righthand side of the stabilised image drop away because summation of the stabilised image on the right hand side with more recent pulse stream segments will not necessarily occur each time a trigger is issued because a further trigger may issue before the segment is large enough to cause integration of the latter half of the stabilised image.

Figure 2:
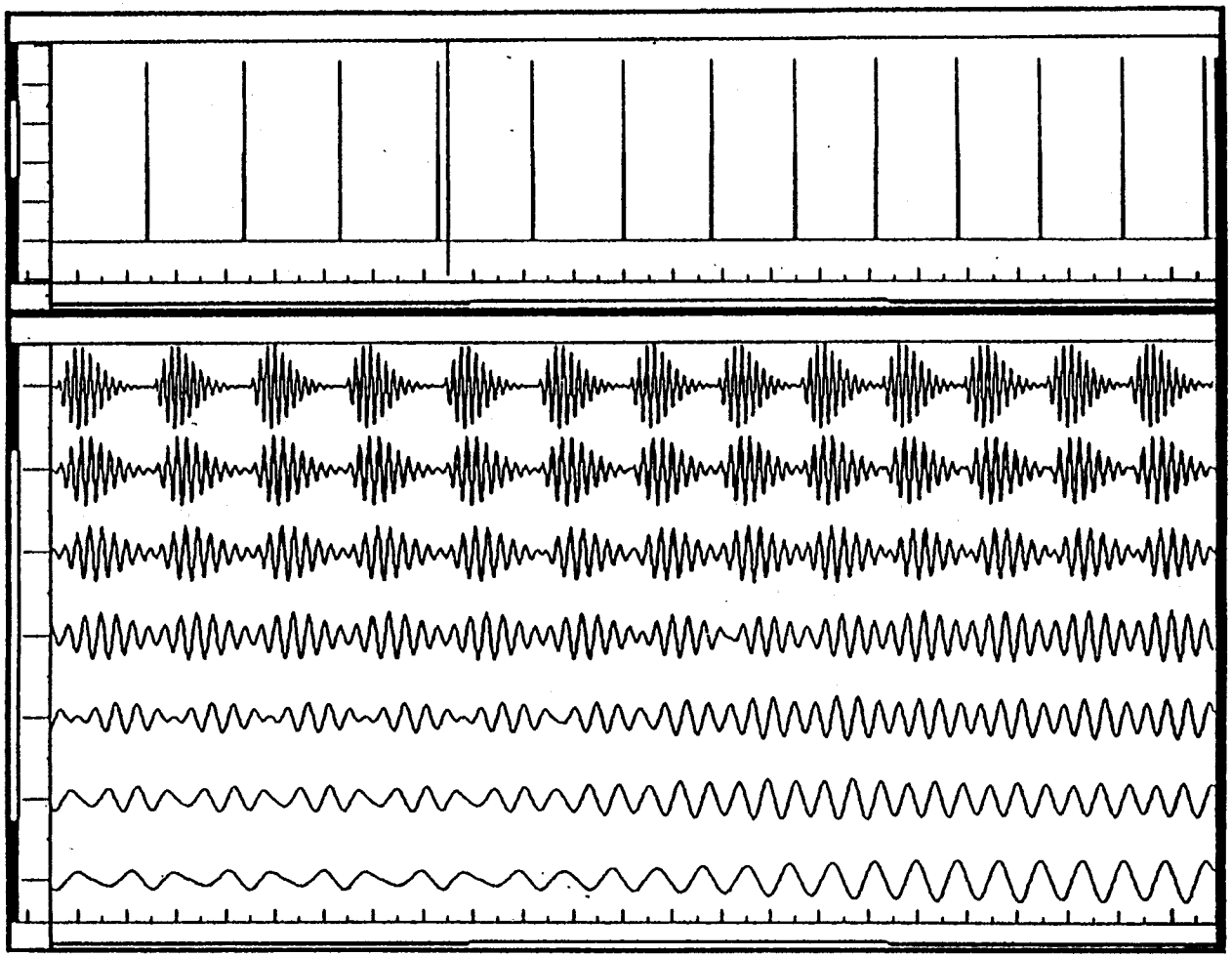
FIG. 2 shows a subset of seven driving waves derived by spectral analysis of a sound wave which starts with a first pitch and then glides quickly to a second pitch.
Figure 3:
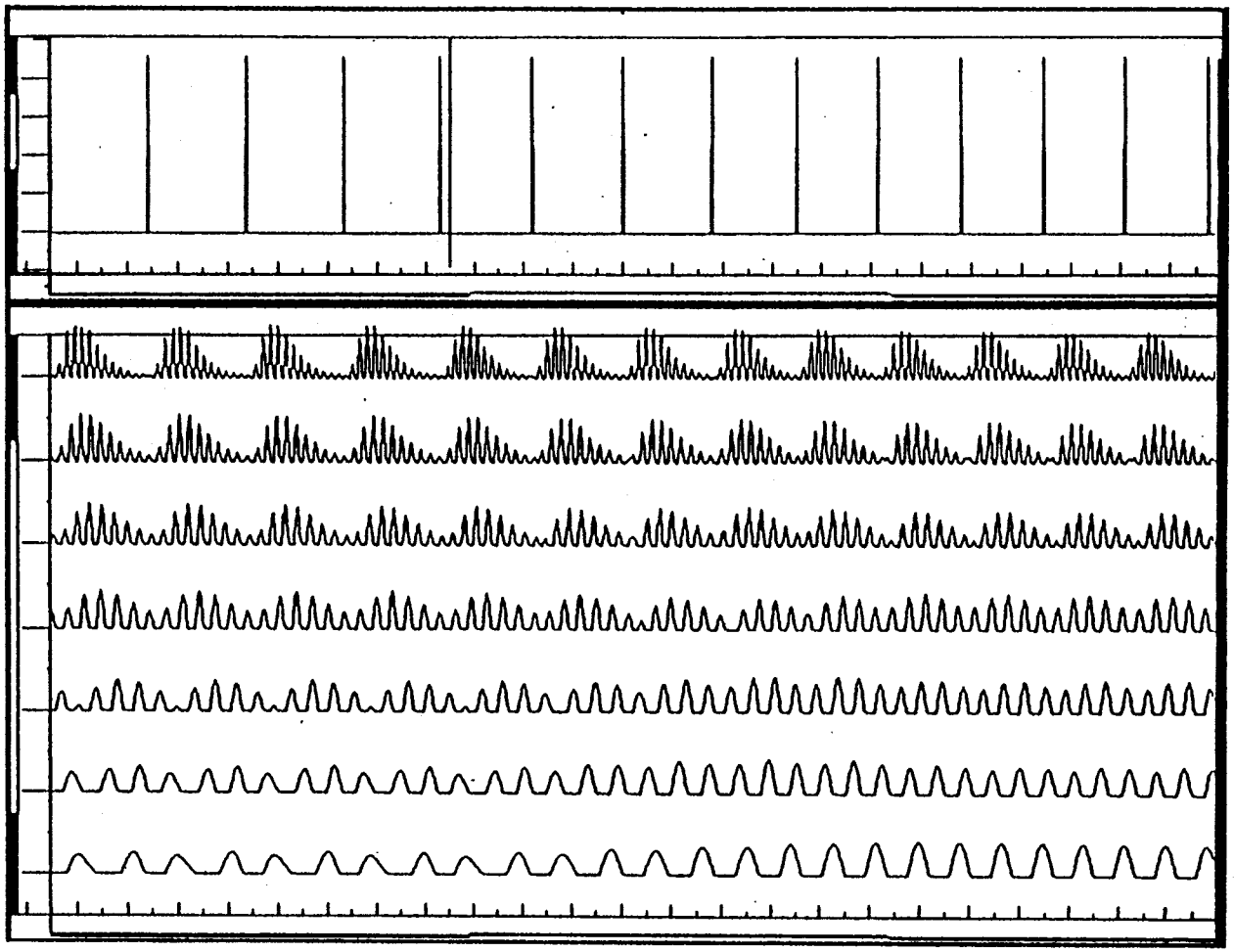
FIG. 3 shows the subset of the seven driving waves shown in FIG. 2 in which the waves have been rectified so that only the positive half of the waves are shown.

In all of the above examples if the waveform from the filter channel remains the same, then the stabilised image produced by the stabilised image generator remains the same and stationary. If the waveform from the filter channel changes as shown in FIGS. 2 and 3 where the pitch glides smoothly from a first pitch to a second higher pitch then the stabilised image will produce a smooth transition from the first pitch to the second pitch corresponding to the changes in the waveform. Thus the stabilised image retains information on the major characteristics of the waveform it represents and avoids substantial loss of information on the waveform itself but avoids interframe variability of the type which would confuse and complicate subsequent analysis of the waveform.

The apparatus and methods outlined above which can be used to distinguish between periodic and aperiodic sound signals are particularly applicable to speech recognition systems. By their use the efficiency with which speech features can be extracted from an acoustic waveform may be enhanced such that speech recognition may be used even on small computers and dictating machines for example so that a user can input commands, programs and text directly by the spoken word without the need of a keyboard. A speech recognition machine is a system for capturing speech from the surrounding air and producing an ordered record of the words carried by the acoustic wave. The main components of such a device are: 1) a filterbank which divides the acoustic wave into frequency channels, 2) a set of devices that process the information in the frequency channels to extract pitch and other speech features and 3) a linguistic processor that analyses the features in conjunction with linguistic and possibly semantic knowledge to determine what was originally said.

Figure 6:
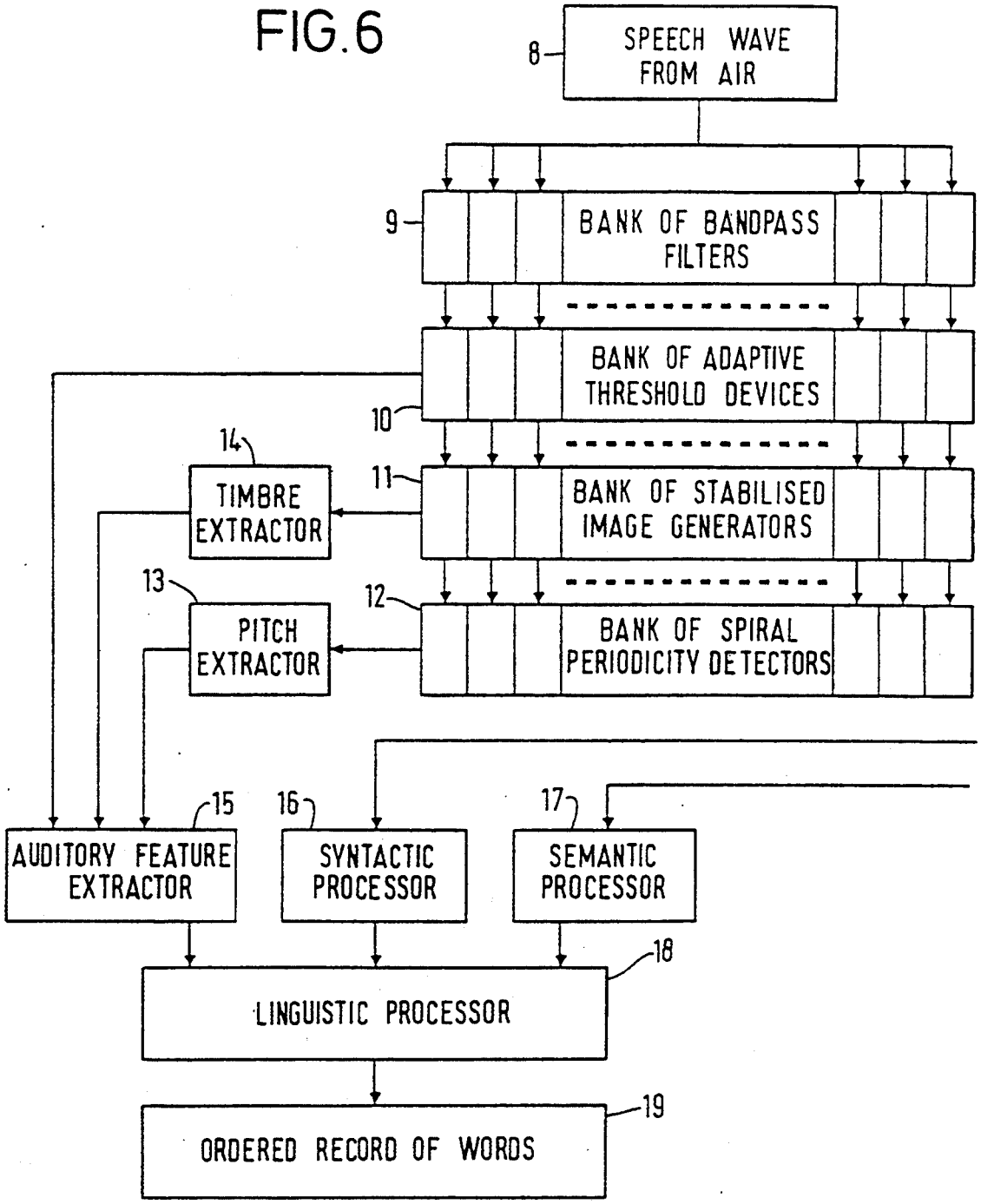
FIG. 6 is a schematic illustration of speech recognition apparatus in accordance with the invention.

With reference to FIG. 6 a schematic diagram of a speech recognition system is shown. It may be seen that the generation of the stabilised image of the acoustic wave occurs approximately half way in the second section of the speech recognition system where the analysis of the sounds takes place. The resultant information then being supplied to the linguistic processor section of the speech recognition system.

The most important parts of speech for speech recognition purposes are the voiced parts of speech particularly the vowel sounds. The voiced sounds are produced by the vibration of the air column in the throat and mouth by the opening and closing of the vocal chords. The resultant voiced sounds are periodic in nature, the pitch of the sound being the frequency of the glottal stops. Each vowel sound also has a distinctive arrangement of four formants which are dominant modulated harmonics of the pitch of the vowel sound and the relative frequencies of the four formants are not only characteristic of the vowel sound itself but are also characteristic of the speaker. For an effective speech recognition system it is necessary that as much information about the pitch and the formants of the voiced sounds is retained whilst also ensuring that other 'noise' does not interfer with the clear identification of the pitch and formants.

Integration of the sound information is not only important for the analysis of the sound itself but is also necessary so that the output data rate is not too high to support a real-time speech recognition system. However, there are a number of issues that arise when an attempt is made to choose the optimum integration time for a traditional speech system which segments either the speech wave itself or the filberbank outputs into a sequency of examples all of the same duration. Generally the integration time is required to be as long as possible because longer integration times reduce the output data rate and reduce the inter-frame variability in the output record. Both of these reductions in turn reduce the amount of computation required to extract speech features or speech events from the output record, provided the record contains the essential information. At the same time, it is important to preserve the temporal acuity required for the analysis of voice characteristics. It is important not to make the integration time so long that it combines the end of one speech event with the start of the next, and so produces an output vector containing average values that are characteristic of neither of the events. Similarly, if the integration time is too long, it will obscure the motion of speech features, because the output vector summarises all of the energy in one frequency band in one single number, and the fact that the frequency was changing during the interval is lost. Thus the integration time must be short enough that it does not combine speech events nor obscure the motion of the speech event. There is the added risk that, whatever the integration time, by using a fixed integration time, whenever the pitch of the sound event and the integration time differ, the output record will contain inter-frame variability that is not a characteristic of the speech itself—but is variability that is generated by the interaction of the sound event with the analysis integration time. Thus use of a variable, triggered integration time as proposed above avoids these problems particularly in relation to speech recognition systems.

FIG. 6 shows schematically a speech recognition system incorporating a bank of stabilised image generators as described above in which the stabilised image generators carry out triggered integration on the input information on the sound to be analysed. The speech recognition system receives a speech wave (8) which is input into a bank of bandpass channel filters (9). The bank of bandpass channel filters (9) provides 24 frequency channels which vary from a low frequency of 100 Hz to a high frequency of 3700 Hz. Of course more channel filters over a much wider or narrower range of frequencies could also be used. The signals from all these channels are then input into a bank of adaptive threshold devices (10). This adaptive threshold apparatus (10) compresses and rectifies the input information and also acts to sharpen characteristic features of the input information and reduce the effects of 'noise'. The output generated in each channel by the adaptive threshold apparatus (10) provides information on the major peak formations in the waveform transmitted by each of the filter channels in the bank (9). The information is then fed to a bank of stabilised image generators (11). The stabilised image generators adapt the incoming information by triggered integration of the information in the form of pulse streams to produce stabilised representations or images of the input pulse streams. The stabilised images of the pulse streams are then input into a bank of spiral periodicity detectors (12) which detect periodicity in the input stabilised image and this information is fed into the pitch extractor (13). The pitch extractor (13) establishes the pitch of the speech wave (8) and inputs this information into an auditory feature extractor (15). The bank of stabilised image generators (11) also input into a timbre extractor (14). The timbre extractor (14) also inputs information regarding the timbre of the speech wave (8) into the auditory feature extractor (15). In addition, the bank of adaptive threshold devices (10) may input information directly into the extractor (15). The auditory feature extractor (15), a syntactic processor (16) and a semantic processor (17) each provide inputs into a linguistic processor (18) which in turn provides an output (19) in the form of an ordered record of words.

The pitch extractor (13) may also be used to input information regarding the pitch of the speech wave back into the contour extractor (7) in order that integration of the stabilised images of the waveforms in each of the channels is carried out in response to the pitch of the speech wave and not at a pre-set time interval.

The spiral periodicity detector (12) has been described in GB2169719 and will not be dealt with further here. The auditory feature extractor (15) may incorporate a memory device providing templates of various timbre arrays. It also receives an indication of any periodic features detected by the pitch extractor (13). It will be appreciated that the inputs to the auditory feature extractor (15) have a spectral dimension and so the feature extractor can make vowel distinctions on the basis of formant information like any other speech system. Similarly the feature extractor can distinguish between fricatives like /f/ and /s/ on a quasi-spectral basis. One of the advantages of the current arrangement is that temporal information is retained in the frequency channels when integration occurs.

The linguistic processor (18) derives an input from the auditory feature extractor (15) as well as an input from the syntactic processor (16) which stores rules of language and imposes restrictions to help avoid ambiguity. The processor (18) also receives an input from the semantic processor (17) which imposes restrictions dependent on context so as to help determine particular interpretations depending on the context.

In the above example, the units (10), (11), (12), (13), and (14) may each comprise a programmed computing device arranged to process pulse signals in accordance with the program. The feature extractor (15), and processors (16), (17), (18) and (19) may each comprise a programmed computer or be provided in a programmed computer with memory means for storing any desired syntax or semantic rules and template for use in timbre extraction.

We claim:

1. A method of generating a stabilized image from a waveform, which method comprises detecting peaks in said waveform, in response to the detecting of a peak sampling a time extended segment of said waveform, and forming a summation output by summing a first signal being the time extended segment of said waveform with a second signal representing an attenuated previous summation output formed from previous time extended segments of said waveform, said summation output tending towards a constant and forming a stabilized image of said waveform when said waveform is constant.

2. A method as claimed in claim 1, wherein the summation output is reduced by time dependant attenuation to form the attenuated summation output.

3. A method as claimed in claim 2, wherein the time dependant attenuation is proportional to the time between successive sampling of time extended segments of said waveform.

4. A method as claimed in claim 1, wherein a first limit of the successive time extended segments of said waveform is determined by the detection of peaks in said waveform.

5. A method as claimed in claim 4, wherein a second limit of the time extended segments of said waveform is a predetermined length of time after the first limit of the time extended segments of said waveform.

6. A method as claimed in claim 4, wherein a second limit of the time extended segments of said waveform is determined by the detection of peaks in said waveform.

7. A method as claimed in claim 1 for the analysis of a non-sinusoidal sound wave, wherein said method comprises the spectral resolution of the waveform into a plurality of filtered waveforms and thereafter the independent generation of a stabilized image of each filtered waveform.

8. A method as claimed in claim 7, wherein pulse streams representing major peaks in each of the filtered waveforms are generated.

9. A method as claimed in claim 7, wherein said method further comprises temporal integration of each of the stabilized images of said filtered waveforms to form a stabilized frequency contour across all channels of the filtered waveforms.

10. A method as claimed in claim 7, wherein said method further comprises the extraction of periodic characteristics of the filtered waveforms.

11. A method as claimed in claim 7, wherein said method further comprises the extraction of timbre characteristics of the filtered waveforms.

12. Apparatus according to claim 11 including means for providing auditory feature extraction from analysis of the filtered waveforms together with syntactic and semantic processor means providing syntactic and semantic limitations for use in speech recognition of the waveform.

13. Apparatus for generating a stabilized image from a waveform, comprising:

a peak detector for receiving and detecting peaks in said waveform;

means for sampling time extended segments of said waveform, said sampling means being coupled to said peak detector;

summing means for summing a first signal being a time extended segment of said waveform with a second signal to form a summation output, said second signal representing an attenuated previous summation output, said summing means being coupled to said sampling means; and feed back means for deriving said second signal from said previous summation output, said feed back means being coupled to said summing means, said summation output tending towards a constant and forming a stabilized image of said waveform when said waveform is constant.

14. Apparatus as claimed in claim 13, wherein the feed back means includes a decay device in a feed back loop which attenuates said summation output such that it is reduced.

15. Apparatus as claimed in claim 13, wherein said sampling means includes gate means coupled to said peak detector and said combining means, said time extended segments of said waveform being sampled by operation of said gate means in response to the detection of peaks by the peak detector.

16. Apparatus as claimed in claim 13, wherein there is further provided a buffer to receive said waveform and to retain a record of time extended segments of said waveform, the buffer being coupled to said sampling means.

17. Apparatus as claimed in claim 13 arranged for the analysis of a non-sinusoidal sound wave, the apparatus comprising filtering means for the spectral resolution of said sound wave into a plurality of filtered waveforms and for each filtered waveform (a) a peak detector for receiving and detecting peaks in said waveform, (b) means for sampling time extended segments of said waveform, said sampling means being coupled to said peak detector, (c) combining means for combining a first signal being a time extended segment of said waveform with a second signal to form a summation output, said second signal being derived from a previous summation output, said combining means being coupled to said sampling means; and (d) feed back means for deriving said second signal from said previous summation output, said feed back means being coupled to said combining means, said summation output tending towards a constant and forming a stabilized image of said waveform when said waveform is constant.

18. Apparatus as claimed in claim 17, wherein there is further provided means to form a pulse stream representing the major peaks in each of the filtered waveforms.

19. Apparatus as claimed in claim 17, wherein there is further provided periodicity detectors arranged to detect and extract information regarding periodic characteristics of the non-sinusoidal sound wave being analyzed.

20. Apparatus as claimed in claim 17, wherein there is further provided a timbre extractor for the extraction of information from the pulse streams regarding the timbre of the non-sinusoidal sound wave being analyzed.

* * * * *